US008567300B1

(12) United States Patent
Cler

(10) Patent No.: US 8,567,300 B1
(45) Date of Patent: Oct. 29, 2013

(54) TIME-DELAYED GUN BORE EVACUATOR

(75) Inventor: Daniel L. Cler, Coatesville, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 297 days.

(21) Appl. No.: 12/951,102

(22) Filed: Nov. 22, 2010

(51) Int. Cl.
*F41A 13/08* (2006.01)

(52) U.S. Cl.
USPC ..... 89/1.2

(58) Field of Classification Search
USPC ..... 89/1.2, 14.05, 14.1
See application file for complete search history.

(56) References Cited

U.S. PATENT DOCUMENTS

| | | | | | |
|---|---|---|---|---|---|
| 2,766,661 | A * | 10/1956 | Margulis | 89/1.2 |
| 2,791,940 | A * | 5/1957 | Speake et al. | 89/1.2 |
| 2,807,986 | A * | 10/1957 | Howard et al. | 89/1.2 |
| 3,118,342 | A * | 1/1964 | Campione et al. | 89/1.2 |
| 3,122,055 | A * | 2/1964 | Roeck, Sr. | 89/1.2 |
| 3,377,918 | A * | 4/1968 | Austin, Jr. et al. | 89/1.2 |
| 3,771,414 | A * | 11/1973 | Graham | 89/1.2 |
| 4,024,790 | A * | 5/1977 | Heiderer | 89/1.2 |
| 4,554,722 | A * | 11/1985 | Derrington | 29/426.5 |
| 5,109,748 | A * | 5/1992 | Bertiller et al. | 89/1.2 |
| 5,245,905 | A * | 9/1993 | Bundy | 89/1.2 |
| 5,404,789 | A * | 4/1995 | Haas | 89/1.2 |
| 7,415,918 | B2 * | 8/2008 | Paul | 89/1.2 |
| 7,798,044 | B2 * | 9/2010 | Webb | 89/1.2 |
| 2007/0006719 | A1 * | 1/2007 | Paul | 89/1.2 |
| 2008/0250915 | A1 * | 10/2008 | Webb | 89/1.2 |

FOREIGN PATENT DOCUMENTS

JP 04227491 A * 8/1992

* cited by examiner

*Primary Examiner* — Benjamin P Lee
(74) *Attorney, Agent, or Firm* — Michael C. Sachs

(57) ABSTRACT

A bore evacuator for a gun tube may include a time-delayed discharge valve. The time-delayed discharge valve may open substantially simultaneously with the opening of the breech of the gun tube. Gas discharged from the bore evacuator may evacuate the bore of the gun tube. The time delay of the time-delayed discharge valve may be activated by gas pressure in the bore evacuator. The bore evacuator may include a pressure-regulating valve for regulating the maximum pressure in the bore evacuator.

15 Claims, 4 Drawing Sheets

TIME-DELAYED GUN BORE EVACUATOR

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and, in particular, to large caliber gun tubes, such as cannons.

Bore evacuators may be used on large caliber cannons. Bore evacuators may be used to remove propellant gases from the gun bore of the cannon after firing. The gun may be attached to a vehicle that may be manned. The rear of the gun may include a breech. The breech may be located inside a crew compartment. Flash-back in the crew compartment may be a hazard. Exposure of the crew to toxic propellant gases may be a hazard.

Some bore evacuator systems may use a reservoir to store high pressure propellant gases. Ports or nozzles may be located in the gun tube to charge and discharge the reservoir. The gun may include a means to quickly open the breech of the gun. The breech may be opened shortly after firing the gun, on return of the gun to battery.

A bore evacuator may use an ejector principle. The reservoir may be charged with high pressure gas as soon as the projectile passes the ports in the gun tube. When pressure in the gun tube falls below the pressure in the reservoir, the high pressure gas may begin to exit the reservoir through the ports in the gun tube. Gas may begin exiting the reservoir about 20 to 50 milliseconds after firing of the gun. As the gas flow begins to exit the ports, the breech of the gun may not be open.

At approximately 500 milliseconds after firing the gun, the breech may be opened. The breech may be opened by an automatic action as the gun returns to battery. As a result of the breech not opening for about 400-500 milliseconds after gas begins to flow out of the reservoir, no fresh air may be drawn into the gun tube. As a result, no propellant gases may be expended from the gun tube. The ports between the gun tube and the reservoir may not provide an ejector action to the propellant gases. The lack of ejector action may be because the pressure difference or suction provided by the ports may not be equalized by drawing fresh air in the gun tube.

When the breech does open, most of the gas may have been exhausted from the reservoir. What little gas pressure remains in the reservoir may then be used to provide ejector action to the gases in the gun tube. As the gas stored in the reservoir flows from the reservoir through the ports and into the gun tube, the stored gas may entrain the propellant gas inside the gun tube and push the propellant gas out of the muzzle end of the tube. As a result, fresh air may be drawn into the gun tube through the open breech. A known ejector system used in a bore evacuator may draw about 10 to 15 times as much gas through the gun tube as the amount of stored gas that may be injected from the reservoir through the ports in the side of the gun tube. Because of the ejector mechanism, bore evacuators may be an efficient mechanism to evacuate propellant gases from a gun bore.

Because of the long delay of about 400-500 milliseconds between when the stored gas begins to flow from the reservoir and when the breech opens, various methods for improving the performance of bore evacuators have been tried. One method may be to increase the reservoir size such that a sufficient amount of stored gas remains in the reservoir when the breech is opened. Using this method, bore evacuators may be significantly oversized.

Another method may be to provide a larger intake port cross-sectional area into the reservoir compared to the discharge port cross-sectional area out of the reservoir. Intake port cross-sectional area may be increased by adding more charging ports that contain check valves.

Another approach may be to use a small high pressure chamber that has a check valve connected to a low pressure chamber. The intake charging ports may be connected to the high pressure chamber and the discharge ports may be connected to the low pressure chamber. As a result, a higher charge volume and/or mass may be obtained for a given discharge port charge area. The higher charge volume or mass may provide a higher pressure at the discharge ports during discharge of the evacuator.

An important factor may be the ratio of the total cross-sectional area of the charge ports to the total cross-sectional area of the discharge ports. As that ratio increases, the amount of discharge time may also increase. Simply increasing the volume of the stored gas may not be effective if the total cross-sectional discharge area is large.

Large caliber guns may operate with vastly differing propellant charges. A single artillery weapon may use different charge configurations. As a result, the bore evacuator may need to function properly over a wide range of charge pressures. Typically, the bore evacuator may be significantly overdesigned to properly function at both low and high charge pressures. Thus, bore evacuators may be rather large and heavy devices.

A need exists for a bore evacuator that may be of a small volume, while providing effective bore evacuation of the gun.

SUMMARY OF THE INVENTION

It is an object of the invention to provide a bore evacuator that may be of a small volume and may provide effective bore evacuation of a gun.

It is another object of the invention to provide a method and apparatus for evacuating a gun tube wherein discharge of gas from the bore evacuator may be delayed beyond the time when the pressure in the gun tube is less than the pressure in the bore evacuator.

One aspect of the invention is a bore evacuator for a gun tube having a bore. The bore evacuator may include a reservoir and at least one intake port between the reservoir and the bore of the gun tube. A one-way valve may be disposed in the intake port. The one-way valve may allow flow only from the bore of the gun tube to the reservoir. The bore evacuator may include at least one discharge port between the reservoir and the bore of the gun tube. A one-way time-delayed valve may be disposed in the discharge port. The one-way time-delayed valve may allow gas flow only from the reservoir to the bore of the gun tube. The one-way time-delayed valve may open substantially simultaneously as a breech of the gun tube opens.

The time delay of the one-way time-delayed valve may be activated by gas pressure in the reservoir. The bore evacuator may also include a pressure-regulating valve fluidly connected to the reservoir for regulating a maximum pressure in the reservoir.

In another aspect of the invention, a bore evacuator for a gun tube may include a three-chambered reservoir having a high-pressure chamber, a low-pressure chamber, and a discharge plenum. At least one intake port may be disposed between the high-pressure chamber and the bore of the gun tube. The bore evacuator may include a one-way valve that only allows gas flow from the high-pressure chamber to the low-pressure chamber. At least one discharge port may be disposed between the discharge plenum and the bore of the gun tube. The bore evacuator may include a one-way time-delayed valve that only allows gas flow from the low-pressure chamber to the discharge plenum. The one-way time-delayed valve may open substantially simultaneously as a breech of the gun tube opens.

A further aspect of the invention is a method. The method may include providing a bore evacuator having a time-delayed discharge valve for a gun tube. The time-delayed discharge valve may be opened substantially simultaneously with opening a breech of the gun tube. The method may include activating a time delay of the time-delayed discharge valve with gas pressure in the bore evacuator.

Before opening the time-delayed discharge valve, the method may include regulating a maximum pressure in the bore evacuator. After opening the time-delayed discharge valve, the method may include evacuating the gun tube using gas from the bore evacuator.

The method may also include drawing fresh air into the breech of the gun tube via ejector flow action created by gas flow from the bore evacuator.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
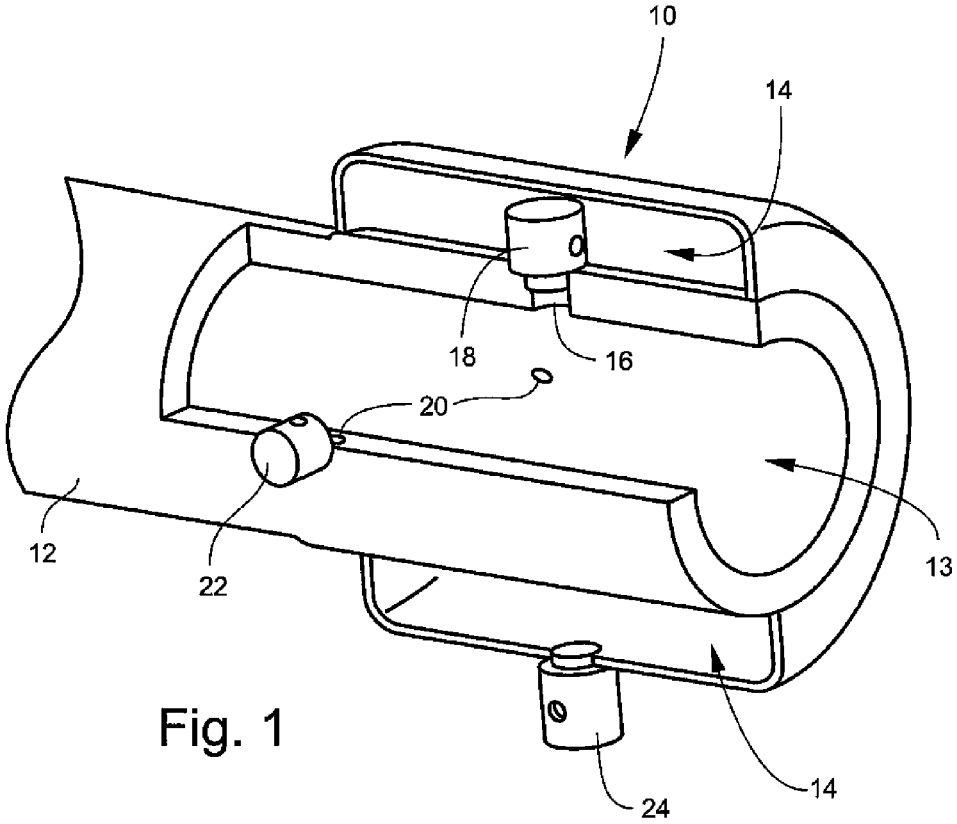
FIG. 1 is a partially cutaway, perspective view of one embodiment of a time-delayed bore evacuator.

FIG. 1 is a partially cutaway, perspective view of one embodiment of a time-delayed bore evacuator 10 for a gun tube 12 having a bore 13. Bore evacuator 10 may include a reservoir 14. Reservoir 14 may be located anywhere along the length of gun tube 12. At least one intake port 16 may be provided between reservoir 14 and bore 13 of gun tube 12. A one-way valve 18 may be disposed in each intake port 16. One-way valve(s) 18 may allow gas flow only from bore 13 to reservoir 14. A plurality of intake ports 16 and respective valves 18 may be used. By way of example only, intake port 16 may have a diameter of about 10 mm.

At least one discharge port 20 may be provided between reservoir 14 and bore 13 of gun tube 12. Discharge port(s) 20 may be angled toward a muzzle end of gun tube 12. In that way, gas flow from port(s) 20 may entrain gas in bore 13 and may exit the muzzle end of the gun tube 12. A one-way time-delayed valve 22 may be disposed in each discharge port 20. One-way time-delayed valve 22 may allow gas flow only from reservoir 14 to bore 13 of gun tube 12. A plurality of discharge ports 20 and respective valves 22 may be used. By way of example only, discharge ports 20 may have diameters of about 4.5 mm.

"Time-delayed" refers to the time difference between when a conventional bore evacuator begins discharging gas into the bore of a gun tube and when the inventive bore evacuator begins discharging gas into a gun tube. In a conventional bore evacuator, discharge from the bore evacuator may begin when the pressure in the bore drops below the pressure in the bore evacuator. In the inventive bore evacuator, discharge from the bore evacuator may begin some time after the pressure in the bore drops below the pressure in the bore evacuator.

Figure 2:
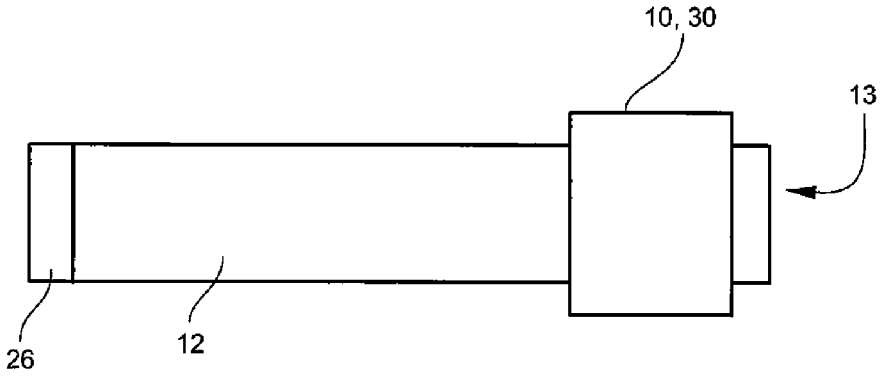
FIG. 2 is a schematic view of a gun tube having a time-delayed bore evacuator.

In one embodiment, bore evacuator 10 may begin discharging gas into the bore 13 when a breech 26 (FIG. 2) of gun tube 12 is opened. In this embodiment, one-way time-delayed valve 22 may open substantially simultaneously with the opening of breech 26 of gun tube 12. "Substantially simultaneously" means the two events may be within a range of about 0 to about 300 milliseconds of each other.

Breech 26 may open when gun tube 12 returns to battery. The recoil of gun tube 12 may activate the opening of breech 26, in a known manner. In some embodiments, one-way time-delayed valve 22 may receive a signal to open from a sensor (not shown) that may sense when breech 26 opens. In other embodiments, time-delayed valve 22 may be a mechanical time delay apparatus, such as, for example, the adjustable time delay apparatus disclosed in U.S. Pat. No. 7,416,030 issued on Aug. 26, 2008 to Lupien et al. The entire content of U.S. Pat. No. 7,416,030 is expressly incorporated by reference herein.

If one-way time-delayed valve 22 is a mechanical time delay apparatus, its time delay may be activated (the time-delay period begins) by gas pressure in reservoir 14. In one embodiment, the time delay of one-way valve 22 may be, for example, about 500 milliseconds. The time delay may be adjusted to coincide with the opening of breech 26.

Bore evacuator 10 may include a pressure-regulating valve 24. Pressure-regulating valve 24 may be fluidly connected to reservoir 14. Pressure-regulating valve 24 may regulate the maximum pressure in reservoir 14. Pressure-regulating valve 24 may relieve excess pressure in reservoir 14 by bleeding gas to the ambient environment. By way of example only, the maximum pressure in reservoir 14 may be about 100-200 psi.

In general, the volume of reservoir 14 may be much less than that of conventional bore evacuators. The volume of reservoir 14 may depend on the caliber of gun tube 12 and the type of ammunition or rounds being fired in tube 12. In one embodiment, the volume of reservoir 14 may be in a range of about 300 cubic inches to about 700 cubic inches. Conventional reservoirs, by contrast, may be four or five times as large as reservoir 14.

When a round is fired in gun tube 12, reservoir 14 may be filled with propellant gases through intake port(s) 16 and one-way intake valve(s) 18. When the gas pressure in reservoir 14 becomes higher than the gas pressure in bore 13, one-way valve(s) 18 may close, thereby trapping the gas in reservoir 14. Reservoir 14 may store the propellant gases until breech 26 opens.

As pressure rises in reservoir 14, the maximum pressure in reservoir 14 may be limited by pressure-regulating valve 24. Valve 24 may communicate between reservoir 14 and the outside atmosphere. As pressure in reservoir 14 begins to rise, the time-delay mechanism in one-way time-delayed discharge valve 22 may be activated. After approximately 500 milliseconds, for example, one-way time-delayed discharge valve 22 may open, thereby porting gases from reservoir 14 to discharge port(s) 20. Ports 20 may communicate directly with bore 13. At substantially the same time as one-way time-delay valve 22 opens, breech 26 may open. The gas from discharge ports 20 may then entrain flow through bore 13 and draw fresh air into the bore 13. Most of the propellant gases from bore 13 may then be evacuated.

Figure 3:
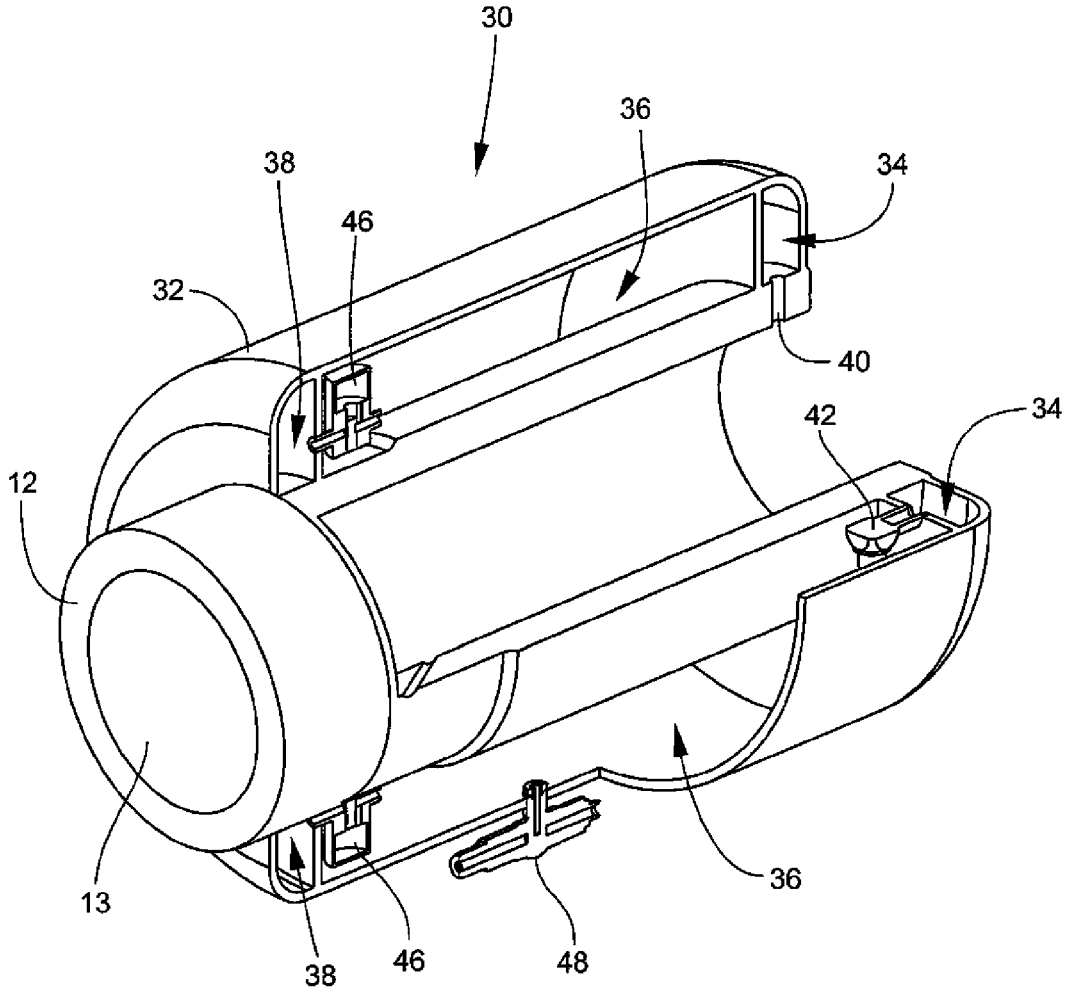
FIG. 3 is a partially cutaway, perspective view of another embodiment of a time-delayed bore evacuator.
Figure 4:
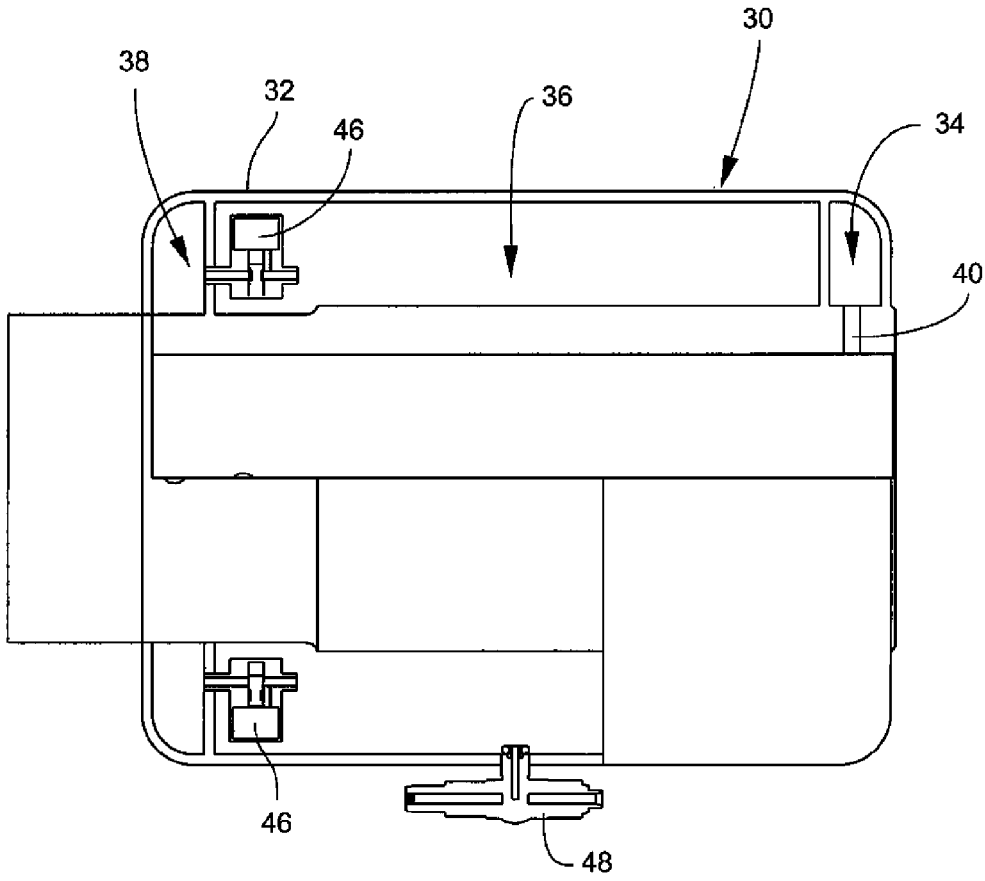
FIG. 4 is a side view of the evacuator of FIG. 3.

FIG. 3 is a partially cutaway, perspective view of another embodiment of a time-delayed bore evacuator 30 for bore 13 of gun tube 12. FIG. 4 is a side view of the evacuator 30 of FIG. 3. Bore evacuator 30 may include a multi-chambered reservoir, for example, a three-chambered reservoir 32. Reservoir 32 may include a high-pressure chamber 34, a low-pressure chamber 36, and a discharge plenum 38.

One or more intake ports 40 may be provided between high-pressure chamber 34 and bore 13 of gun tube 12. One or more one-way valves 42 may be disposed between high-pressure chamber 34 and low-pressure chamber 36. One-way valves 42 may only allow gas flow from high-pressure chamber 34 to low-pressure chamber 36. One or more discharge ports 44 may be provided between discharge plenum 38 and bore 13 of gun tube 12.

One or more one-way time-delayed valves 46 may be disposed between low-pressure chamber 36 and discharge plenum 38. One-way time-delayed valves 46 may only allow gas flow from low-pressure chamber 36 to discharge plenum 38. One-way time-delayed valves 46 may open substantially simultaneously with the opening of breech 26 of gun tube 12.

One-way time-delayed valves 46 may operate similar to one-way time delay valves 22 of the embodiment of FIG. 1. That is, operation of valves 46 may be controlled by a "breech-open" sensor, or valves 46 may be mechanically time-delayed. The time delay of one-way time-delayed valves 46 may be activated by gas pressure in low-pressure chamber 36. In one embodiment, the time delay of one-way valves 46 may be about 500 milliseconds.

Bore evacuator 30 may include a pressure-regulating valve 48. Pressure-regulating valve 48 may be fluidly connected to low-pressure chamber 36. Pressure-regulating valve 48 may regulate the maximum pressure in low-pressure chamber 36. Pressure-regulating valve 48 may relieve excess pressure in chamber 36 by bleeding gas to the ambient environment of gun tube 12.

In general, the volume of reservoir 32 may be much less than that of conventional bore evacuators. The volume of reservoir 32 may depend on the caliber of gun tube 12 and the type of ammunition or rounds being fired in tube 12. In one embodiment, the volume of reservoir 32 may be in a range of about 300 cubic inches to about 700 cubic inches for a typical large caliber direct fire weapon. Conventional reservoirs, by contrast, may be four or five times as large as reservoir 32.

The volume of low-pressure chamber 36 may be at least as large as the sum of the volumes of high-pressure chamber 34 and discharge plenum 38. In one embodiment, low-pressure chamber 36 may be about 80% of the volume of reservoir 32, and each of high-pressure chamber 34 and discharge plenum 38 may be about 10% of the volume of reservoir 32.

An advantage of a multi-chambered reservoir, such as reservoir 32, may be that the valves 42 and 46 are not directly exposed to the harsh environment of bore 13. The harsh environment of bore 13 may include high temperatures, high pressures and erosive gases. So, valves 42 and 46 may be less costly to manufacture.

In bore evacuator 30, high-pressure chamber 34 may be filled with propellant gas through ports 40. High-pressure chamber 30 may communicate with larger, low-pressure chamber 36 through one-way charge check valve(s) 42. One-way time-delay valves 46 may be disposed between low-pressure chamber 36 and discharge plenum 38. Discharge plenum 38 may include discharge ports 44. After about a 500 millisecond time delay, valves 46 may open and communicate flow between low-pressure chamber 36 and discharge plenum 38. The flow may then exit discharge plenum 38 and enter bore 13 through discharge port(s) 44.

Bore evacuators 10 and 30 may use substantially smaller volumes of gas, at lower pressures, than conventional bore evacuators. Thus, the overall volume of evacuators 10 and 30 may be less than conventional bore evacuators. Also, the lower pressures of evacuators 10 and 30 may reduce the required wall thickness of reservoirs 14 and 32.

Figure 5:
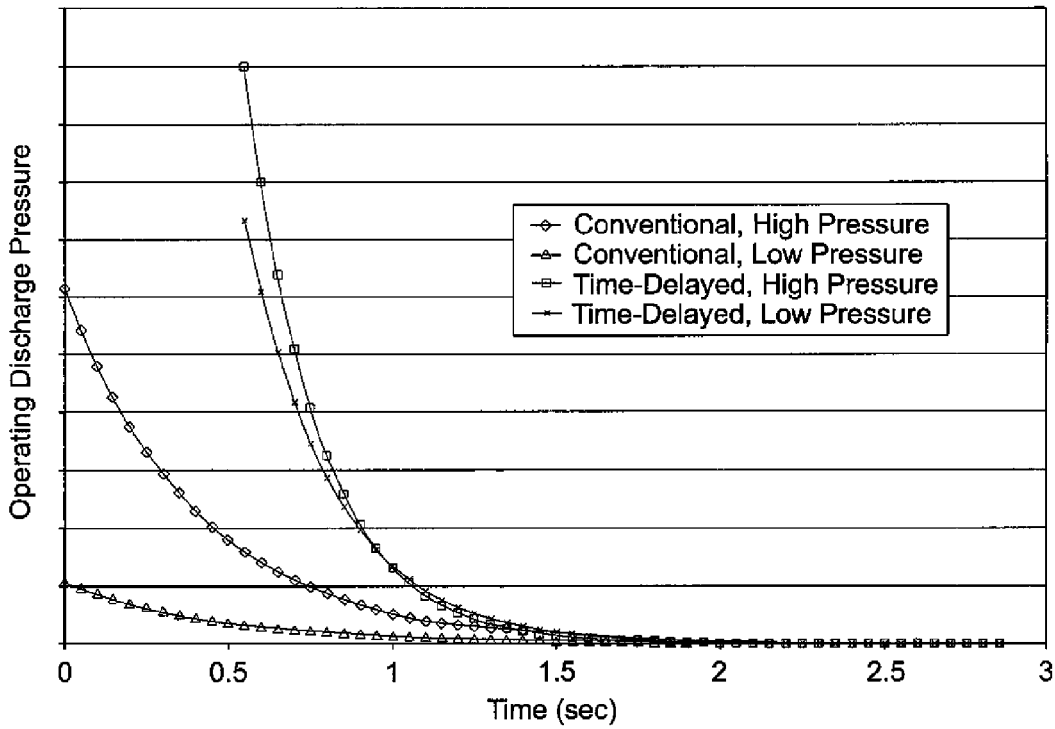
FIG. 5 is a plot of simulated bore evacuator pressure as a function of time for a gun tube with a conventional bore evacuator (data points are shown as diamonds and triangles) and a time-delayed bore evacuator (data points are shown as squares and X marks).

FIG. 5 is a plot of simulated bore evacuator pressure as a function of time for a gun tube with a conventional bore evacuator (data points are shown as diamonds and triangles) and a time-delayed bore evacuator (data points are shown as squares and X marks). In FIG. 5, two different ammunition types are simulated. A higher pressure ammunition has data points shown as squares and diamonds and a lower pressure ammunition has data points shown as X marks and triangles.

As can be seen in FIG. 5, the discharge of the time-delayed evacuator may be delayed by about 500 milliseconds compared to the conventional bore evacuator. For both the high and low pressure ammunition, the initial pressure of the time-delayed evacuator at the time the breech of the gun opens (around 500-700 milliseconds) is significantly higher than the initial pressure of the conventional evacuator. The higher pressure may improve ejector performance. Also, the time-delayed evacuator may provide more than one full tube of air exchange for both ammunition types, while the conventional evacuator may do so for only the high pressure ammunition. Because the pressure regulator limits the maximum pressure for the high pressure ammunition and the low pressure ammunition, both the high pressure ammunition and the low pressure ammunition may have similar bore evacuation performance. The combination of the pressure regulator and the time delay mechanism may provide a consistently high initial pressure when the breech opens.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A bore evacuator for a gun tube having a bore, comprising:

a reservoir;

at least one intake port between the reservoir and the bore of the gun tube;

a one-way valve disposed in the at least one intake port, the one-way valve allowing gas flow only from the bore of the gun tube to the reservoir;

at least one discharge port between the reservoir and the bore of the gun tube; and a one-way time-delayed valve disposed in the at least one discharge port, the one-way time-delayed valve allowing gas flow only from the reservoir to the bore of the gun tube, wherein the one-way time-delayed valve opens substantially simultaneously as a breech of the gun tube opens.

2. The bore evacuator of claim 1, wherein a time delay of the one-way time-delayed valve is activated by gas pressure in the reservoir.

3. The bore evacuator of claim 2, wherein the time delay of the one-way valve is about 500 milliseconds.

4. The bore evacuator of claim 1, further comprising a pressure-regulating valve fluidly connected to the reservoir for regulating a maximum pressure in the reservoir.

5. The bore evacuator of claim 1, wherein the at least one intake port between the reservoir and the bore of the gun tube includes a plurality of intake ports between the reservoir and the bore of the gun tube, the bore evacuator further comprising one-way valves for each of the plurality of intake ports, the one-way valves allowing gas flow only from the bore of the gun tube to the reservoir.

6. The bore evacuator of claim 5, wherein the at least one discharge port between the reservoir and the bore of the gun tube includes a plurality of discharge ports between the reservoir and the bore of the gun tube, the bore evacuator further comprising one-way time delayed valves for each of the plurality of discharge ports, the one-way time-delay valves allowing gas flow only from the bore of the gun tube to the reservoir.

7. The bore evacuator of claim 4, wherein a volume of the reservoir is in a range of about 300 cubic inches to about 700 cubic inches.

8. A bore evacuator for a gun tube having a bore, comprising:

a three-chambered reservoir including a high-pressure chamber, a low-pressure chamber, and a discharge plenum;

at least one intake port between the high-pressure chamber and the bore of the gun tube;

a one-way valve that only allows gas flow from the high-pressure chamber to the low-pressure chamber;

at least one discharge port between the discharge plenum and the bore of the gun tube; and a one-way time-delayed valve that only allows gas flow from the low-pressure chamber to the discharge plenum, wherein the one-way time-delayed valve opens substantially simultaneously as a breech of the gun tube opens.

9. The bore evacuator of claim 8, wherein a time delay of the one-way time-delayed valve is activated by gas pressure in the low-pressure chamber.

10. The bore evacuator of claim 9, wherein the time delay of the one-way valve is about 500 milliseconds.

11. The bore evacuator of claim 8, further comprising a pressure-regulating valve fluidly connected to the low-pressure chamber for regulating a maximum pressure in the low-pressure chamber.

12. The bore evacuator of claim 8, wherein the at least one intake port between the high-pressure chamber and the bore of the gun tube includes a plurality of intake ports between the high-pressure chamber and the bore of the gun tube.

13. The bore evacuator of claim 12, wherein the at least one discharge port between the discharge plenum and the bore of the gun tube includes a plurality of discharge ports between the discharge plenum and the bore of the gun tube.

14. The bore evacuator of claim 11, wherein a volume of the three-chambered reservoir is in a range of about 300 cubic inches to about 700 cubic inches.

15. The bore evacuator of claim 11, wherein a volume of the low-pressure chamber is at least as large as a sum of volumes of the high-pressure chamber and the discharge plenum.

* * * * *